United States Patent [19]

Post et al.

[11] Patent Number: 4,508,006

[45] Date of Patent: Apr. 2, 1985

[54] DEVICE FOR QUICKLY STOPPING A REMOTE CONTROLLED AUTOMATIC CANNON

[75] Inventors: Lothar Post, Düsseldorf; Bernhard Schneider, Monchen-Gladbach, both of Fed. Rep. of Germany

[73] Assignee: Rheinmetall GmbH, Düsseldorf, Fed. Rep. of Germany

[21] Appl. No.: 371,965

[22] Filed: Apr. 26, 1982

[30] Foreign Application Priority Data

Apr. 25, 1981 [DE] Fed. Rep. of Germany ..... 3116541

[51] Int. Cl.[3] ..... F41F 11/04

[52] U.S. Cl. ..... 89/24; 89/9

[58] Field of Search ..... 89/11, 129 R, 130, 132, 89/133, 135, 137, 7

[56] References Cited

U.S. PATENT DOCUMENTS

| | | | |
|---|---|---|---|
| 3,648,561 | 3/1972 | Stoner | 89/11 |
| 3,800,657 | 4/1974 | Broxholm | 89/7 |
| 4,131,052 | 12/1978 | Skahill | 89/11 |
| 4,154,143 | 5/1979 | Pechamat et al. | 89/11 |
| 4,193,335 | 3/1980 | Tassie | 89/11 X |
| 4,301,709 | 11/1981 | Bohorquez et al. | 89/11 |
| 4,391,180 | 7/1983 | Koine | 89/129 R |

FOREIGN PATENT DOCUMENTS

| | | | |
|---|---|---|---|
| 0063680 | 11/1982 | European Pat. Off. | 89/9 |
| 2658770 | 7/1978 | Fed. Rep. of Germany . | |
| 3021200 | 12/1980 | Fed. Rep. of Germany . | |
| 534689 | 1/1922 | France | 89/11 |
| 187192 | 10/1922 | United Kingdom . | |

*Primary Examiner*—Richard E. Schafer
*Assistant Examiner*—John S. Maples
*Attorney, Agent, or Firm*—Spencer & Frank

[57] ABSTRACT

A device for quickly stopping a remote controlled automatic cannon having a breech block which can be moved by means of an endless control groove in an essentially rotationally symmetrical control roller, with each region of the control groove being associated with a respective function step within the firing cycle of the cannon. The device includes an element which rotates in dependence on the control roller and is provided with a stop abutment which is associated with a region of the control groove; and a control piston, which corresponds with the stop abutment, and which, during operation, can be moved axially, by propellant gases developed during firing of the cannon, so that one free end of the piston moves out of the circular path of movement of the stop abutment against a return force, and thus from a blocking position with respect to the stop abutment, into a release position with respect to the stop abutment.

6 Claims, 7 Drawing Figures

DEVICE FOR QUICKLY STOPPING A REMOTE CONTROLLED AUTOMATIC CANNON

BACKGROUND OF THE INVENTION

The present invention relates to an apparatus for quickly stopping a remote controlled automatic cannon having a breech block which can be moved by means of an endless control groove in an essentially rotationally symmetrical control roller with each region of the control groove being associated with a respective function step within the firing cycle.

A device of the same general species used in a weapon of the above-mentioned type is disclosed in German Offenlegungsschrift DE OS No. 26 58 770 published July 6, 1978 and in corresponding U.S. patent application Ser. No. 168,331 filed July 14, 1980, now U.S. Pat. No. 4,391,180, issued July 5, 1983. In the disclosed weapon, a volume of propellant gas tapped from the gun barrel is used to actuate a clutch on the drive side of the breech block. If a respective control pulse does not appear, for example due to misfiring, the clutch is released and consequently no torque is transmitted. Although this device has been found acceptable in practice, there nevertheless arises the task of providing a likewise simple, fast acting quick stop device which can be easily integrated in a weapon and which assures stopping in case of a malfunction without unlocking the breech block.

SUMMARY OF THE INVENTION

It is therefore the object of the present invention to provide a simple fast acting quick stop device for the breech block of an automatic cannon which assures stopping of the cannon in the case of a malfunction without unlocking the the breech block.

The above object is basically achieved according to the present invention by providing a device for quickly stopping a remote controlled automatic cannon having a breech block which can be moved by means of an endless control groove in an essentially rotationally symmetrical control roller wherein each region of the control groove is associated with a respective function step within the firing cycle of the cannon, with the device comprising: an element which rotates in dependence on the rotation of the control roller and which is provided with a stop abutment which is associated with a particular region of the control groove; a control piston having a first free end and with the control piston being mounted adjacent the element such that its free end can be moved into and out of the circular path of movement of the stop abutment; a means for applying an axial force on the piston to normally move the free end of the piston into the path of movement of the stop abutment and thus into a blocking position with respect to the stop abutment; and means for applying propellant gases developed during firing of the cannon to the piston to move the free end of the piston out of the path of movement of the stop abutment, and thus into a release position with respect to the stop abutment.

According to a feature of the invention, an arrangement is provided for holding or maintaining the control piston in the release position for a defined period of each firing cycle. According to one embodiment of the invention this holding means includes an arrangement, including a control disc and a control member, which is positively driven in sychronism with the movement of the control roller so as to engage and lock the control piston in the released position for a period of the firing cycle. According to the other embodiment of the invention, when the control piston is moved to the release position by the propellant gas, a blocking lever, which is articulated to the housing for the control piston, pivots into the path of movement of the control piston and prevents same from exiting the housing and moving into the path of movement of the stop abutment until the lever is pivoted out of the path of movement of the control piston by a cam.

BRIEF DESCRIPTION OF THE DRAWINGS

The invention will be explained in greater detail with the aid of two preferred embodiments of the invention which are shown in the drawings essentially schematically without any details which are not of importance for the invention.

DETAILED DESCRIPTION OF THE PREFERRED EMBODIMENTS

Figure 1:
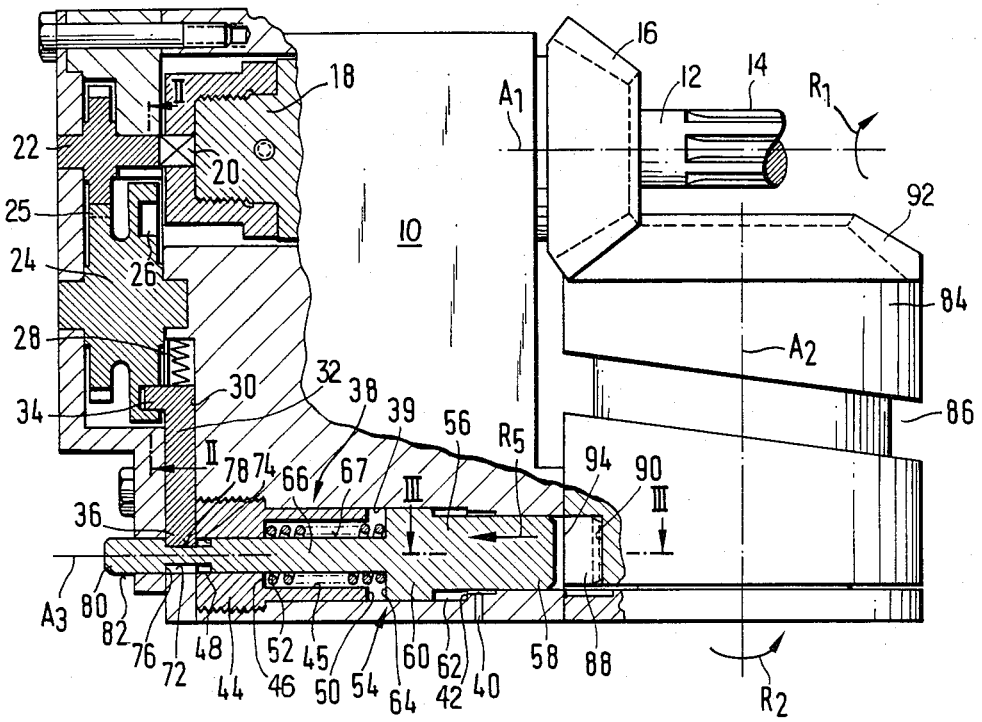
FIG. 1 is a sectional view of a first embodiment of a device according to the invention in a plane formed by the two axes of rotation $A_1$ and $A_2$.
Figure 2:
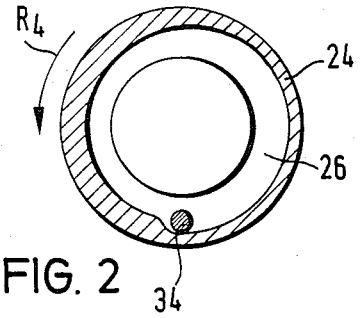
FIG. 2 is a partial sectional view along the line II—II of FIG. 1.
Figure 3:
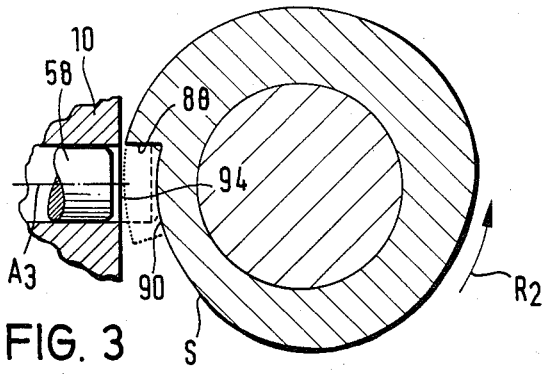
FIG. 3 is a partial sectional view along the line III—III of FIG. 1.

Referring now to the first embodiment of the invention as shown in FIGS. 1, 2 and 3, there is shown a housing 10 in which there is mounted a drive shaft 12 which is provided with a bevel gear 16 in the vicinity of a splined shaft end 14. The other end of the drive shaft 12, i.e. the end 18 remote from the splined shaft end 14, is connected via a clutch or coupling 20 with an intermediate gear 22 which meshes with a ring of teeth 25 of a control disc 24 rotatably mounted in the housing 10. On its surface facing the splined shaft end 14, the control disc 24 is provided with an endless control contour or groove 26. A control member 32 is arranged to be axially movable in a vertical guide 30 within the housing 10. The upper end of the control member 32 is in contact with a return spring 28 which tends to urge the control member 32 in a downward direction. The upper end of the control member 32 is provided with a transversely extending cam follower 34 which extends into groove 26 of the control disc 24 and thus follows the control contour of the groove 26 to cause movement of the control member 32, which also has a free lower end 36.

Disposed in the underside of the housing 10 is a horizontal guide 38 of circular cylindrical design, which serves to accommodate a control piston 54. The cylindrical face 39 of the guide 38 has a step 42 in the vicinity of a gas inlet 40 which is connected to and in communication with a tap on the cannon barrel (not shown) via a line (likewise not shown). On the side facing away from the step 42, a spring bushing 44 is screwed into the guide 38. A portion of the bushing 44 facing the gas inlet 40 is provided with an inner cylindrical surface 45 which is defined by an interior circular abutment 46 and an exterior annular frontal face 50. The bushing 44 is provided with a through bore 48 having a smaller diameter than that of the inner surface 45.

The control piston 54 which is arranged to be axially movable in the guide 38 is provided at one end with a guide shaft 56 having a free end 58. Adjacent to the guide shaft 56, the piston 54 has a major portion or member 60 which has the largest diameter and serves as the piston element. The portion 60 is provided with an annular face 62 facing the gas inlet 40 and an annular counterface 64 facing away from the annular face 62. The spring supporting shaft 66 of the control piston 54 is provided with a recess 72 defined by a circumferential face 78 between a frontal step 76 and a rear step 74. Immediately adjacent the frontal step 76 there is the circumferential face 82 of a free front end 80 of the piston 54, with the surface 82 having a larger diameter than the face 78. The bore 48 of the spring bushing 44 encloses the circumferential face surface 67 of the shaft 66 and one end of a helical compression spring 52 is supported at the annular abutment 46 of the spring bushing 44 while the other end of the spring 57 is supported at the annular counterface 64 of the control piston 54 and urges the latter toward the right where there is an opening 94 for the passage of the free end 58 of the control piston 54.

The bevel gear 16 of the drive shaft 12 meshes with a ring of bevel teeth 92 of a control roller 84. This ring of teeth 92 is at the upper side of the control roller 84 whose axis of rotation $A_2$ intersects both the axis of rotation $A_1$ of the drive shaft 12 and the longitudinal axis $A_3$ of the control piston 54 at a right angle. The control roller 84 further has a control groove 86 on its circumference which, in order to actuate a wedge-type breech block (not shown), extends over a given axial length of the control roller 84. In a manner well known in the art, a discrete position of the breech block within a firing cycle is associated with each region of the control groove 86. In a lower region (not identified in detail), the control roller 84 is provided with a supporting surface 90 for the free end 58 of the control piston 54 (see FIG. 3). The supporting surface 90 surrounds the axis of rotation $A_2$ over an angle of 360° beginning and ending at a stop abutment 88. The path of the supporting surface 90 and the arrangement of the stop abutment 88 correspond in a strictly prescribed manner with the control groove 86 and with the control contour 26 of the control disc 24. By this arrangement, the perfect functioning of the control independent of the fire rate of the cannon is guaranteed. This will clearly be understood when considering the following description of the mode of operation.

The device shown in FIGS. 1 to 3 operates as follows:

By rotating the drive shaft 12 in the sense of the directional arrow $R_1$, there results a rotation of the control roller 84 in the sense of the directional arrow $R_2$ as well as a rotation of the control disc 24 in the sense of the directional arrow $R_4$ (FIG. 2). The stop abutment 88 is assumed to be in the position shown in dashed lines with the free end 58 of the control piston 54 being in contact with the supporting surface 90. The free lower end 36 of the control member 32 rests on the circumferential surface 82 of the free end 80 of the spring shaft 66 of the control piston 54. The individual steps of the respective firing cycle under consideration now take place. Let it be assumed that the wedge-type breech block is locked and that a shot is fired as soon as a point S on the surface 90 passes the axis $A_3$ (FIG. 3). A partial volume of propellant gas, which has been branched off from the barrel, passes through the gas inlet 40 into the cylindrical guide 38 in front of the annular face 62 of the control piston 54 and presses the latter to the left in the direction of the arrow $R_5$ against the force of the return spring 52. This causes the lower end 36 of the control member 32 to drop into the slit or recess 72 under the force of the return spring 28. Thus the stop abutment 88 can pass opening 94 without interference. Thereafter the control member 32, which the control contour 26 of the control disc 24 presses upwardly via the cam follower 34 and against the force of the return spring 28, is raised so that its free lower end 36 releases the control piston 54 so that the control piston 54 is driven to the right, again under the returning force of its associated compression spring 52, and comes to rest on the supporting surface 90. Assuming proper operation, the above described sequence is repeated as long as the fire initiating device, which will not be discussed in detail here, is actuated and firing occurs.

In the case of misfiring and again under consideration of FIGS. 1, 2, and 3, there results the above-described sequence with the difference that no shot is fired when point S passes through the extension of axis $A_3$. Consequently, no volume of propellant gas is produced which could deflect the control piston 54 toward the left. The stop abutment 88 abuts on the free end 58 of the control piston 54 which projects into its circular path of movement. This results in the rotary movement of the control roller 84 being blocked and, for safety's sake, the breech block remaining closed.

Even if firing is delayed it must be assured that the breech block remains closed at least during the time of passage of the projectile. This is done as follows:

Due to the delayed firing, the stop abutment 88 abuts against the free end 58 of the control piston 54. While the breech block is still closed, the control roller 84 is stopped. When the shot is fired (with a delay), the control piston 54 is driven to the left, the control roller 84 moves on again and before it reaches its zero position shown in dot-dash lines—given by the angular path associated with the period of passage of the projectile and the subsequent releasing and opening of the breech block—the projectile has left the barrel. A sequence of further firing cycles follows as long as the above-mentioned fire initiating device is actuated and firing occurs.

Figure 4:
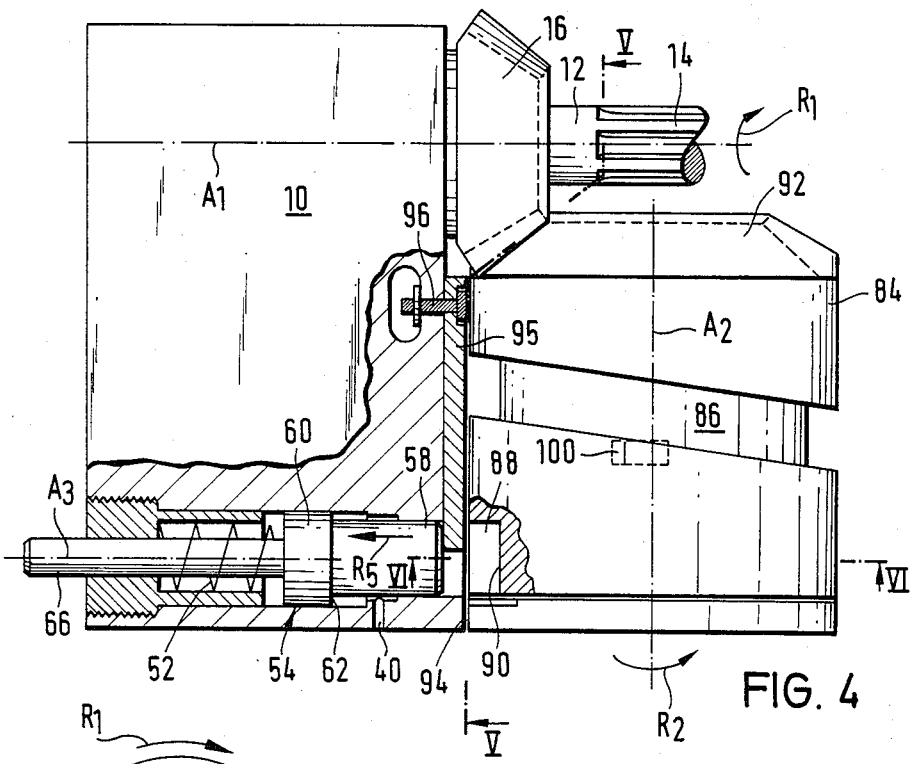
FIG. 4 is a sectional view of a second simplified embodiment of a device according to the invention in a plane formed by the two axes of rotation $A_1$ and $A_2$.
Figure 5:
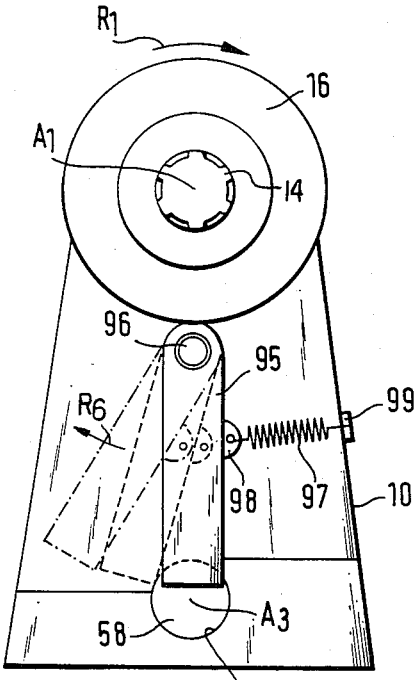
FIG. 5 is a partial sectional view along the line V—V of FIG. 4.
Figure 6:
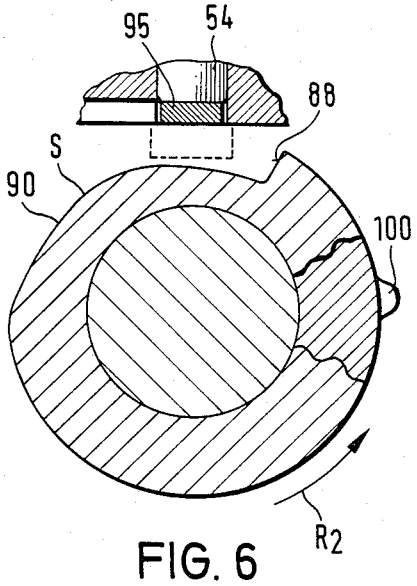
FIG. 6 is a partial sectional view along the line VI—VI of FIG. 4.

In the second (simplified) embodiment shown in FIGS. 4, 5 and 6, a blocking lever 95 is articulated to the housing 10 at 96 and the free end of this lever 95 is able to block the opening 94 and thus prevent the free end 58 of the control piston 54 from passing through. A tension spring 97 has one of its ends fixed in an eye 98 on the blocking lever 95 and its other end attached to the housing 10 at 99. The blocking lever 95 can be deflected clockwise against the return force of the tension spring 97 in the direction of the arrow $R_6$. At a given point on its circumferential face, the control roller 84 is provided with a deflecting cam 100 in such a way that rotation of the roller 84 will cause the cam 100 to periodically engage the blocking lever 95 and deflect same in the direction of arrow $R_6$.

In FIG. 5, the blocking lever 95 is shown in dashed lines in its starting or release position in which it rests against the circumferential surface of the guide shaft 56 of the control piston 54. The free end 58 of the control piston 54 rests on the supporting surface 90 of the control roller 84 which rotates in operation in the direction of the arrow $R_2$ (FIG. 6). If there is no malfunction, a shot is fired when point S passes the extension of axis $A_3$. At that time, the control piston 54 is deflected to the left by the tapped propellant gas volume acting against the return force of the compression spring 52, allowing the blocking lever 95 to drop into its blocking position, shown in FIG. 5 in solid lines, under the return force of the tension spring 97 and thus permitting the stop abutment 88 to pass the opening 94 without interference. During the further rotary movement of the control roller 84, the deflection cam 100 comes into contact with the blocking lever 95 and deflects it, in the direction of arrow $R_6$ and against the return force of the tension spring 97, into the position shown in dot-dash lines in FIG. 5. Under the return force of its associated compression spring 52, the control piston 54 can now leave the opening 94 again toward the right, opposite to the direction of arrow $R_5$, and can come in contact with the supporting surface 90. Assuming proper operation without malfunctions, the above-described sequence is repeated as long as the fire initiating device is actuated.

If there is a malfunction or another problem having the same effect, no gas pressure is produced to deflect the control piston 54 in the direction of arrow $R_5$; the free end 58 of the piston remains in contact with the supporting surface 90 so that, when the stop abutment 88 abuts on the free end 58 of the control piston 54, the rotary movement of the control roller 84 is blocked.

If there is a delay in firing, the stop abutment 88 abuts against the free end 58 of the control piston 54, as already described in connection with the first embodiment of the invention, and the control roller 84 can continue to rotate only after the gas pressure generated during firing has deflected the free end 58 of the control piston 54 toward the left, i.e. out of the path of movement of the stop abutment 88.

The two illustrated and described embodiments relate to the use of the invention in an automatic weapon having a wedge-type breech block. However, the invention is also applicable for a roller-controlled linear action breech block. For use with a linear action breech block a control roller corresponding to control roller 84 must be arranged horizontally with a stop abutment at its frontal face.

Figure 7:
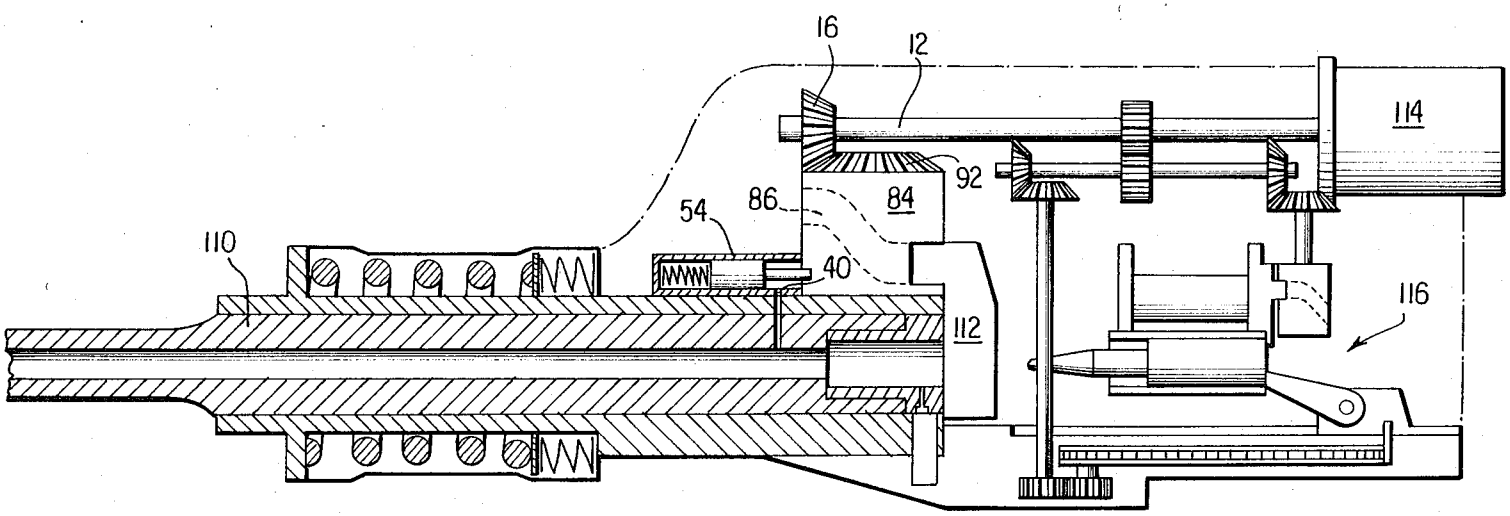
FIG. 7 shows the automatic cannon in a schematical view whereby only those parts are described which are essential in understanding the invention.

In FIG. 7, an automatic cannon equipped with the second embodiment of the invention comprises a barrel 110, a breech block 112, a motor 114 and a loader 116, the latter only being shown for reasons of completeness and for better understanding. All the other parts showing respective numerals are already prescribed in detail in connection with the FIGS. 1 through 6.

To show an example of an automatic cannon having a breech block controlled by a control roller, reference is referred to U.S. Pat. No. 3,648,561, issued Mar. 14, 1972.

In addition to German Offenlegungsschrift DE-OS No. 25 68 770 is referred to in the background above, further reference is made to German Offenlegungsschrift DE-OS No. 30 21 200, corresponding to U.S. patent application Ser. No. 46,664, filed June 6, 1979, now U.S. Pat. No. 4,301,709, issued Nov. 24, 1981, relating to a mechanical anti-hangfire system.

It will be understood that the above description of the present invention is susceptible to various modifications, changes and adaptations, and the same are intended to be comprehended within the meaning and range of equivalents of the appended claims.

We claim:

1. A device for quickly stopping a remote controlled automatic cannon having a breech block which can be moved by means of an endless control groove in an essentially rotationally symmetrical control roller, wherein each region of the control groove is associated with a respective function step within the firing cycle of the cannon, said device comprising in combination:

an element which rotates in dependence on the rotation of said control roller, said element being provided with a stop abutment which is associated with a particular region of said control groove in said control roller;

a control piston having a first free end and a second free end, said piston being mounted adjacent said element such that its said first free end can be axially moved into and out of the circular path of movement of said stop abutment;

means, including a drive shaft, for driving said control roller;

means for applying an axial force on said piston to normally move said first free end into said path of movement and thus into a blocking position with respect to said stop abutment;

means for applying propellant gases developed during firing of the cannon to said piston to move said first free end out of said path of movement of said stop abutment and thus into a release position with respect to said stop abutment; and means for holding said control piston in said release position for a defined period during a firing cycle, said means for holding said control piston in said release position including, a recess formed in the peripheral surface of said second free end of said control piston, a control member, means for mounting said control member so that it is movable transversely to the longitudinal axis of said piston into and out of said recess, and means for moving said control member in dependence on the rotary movement of the drive shaft for said control roller.

2. A device as defined in claim 1 wherein said means for moving said control member includes a control disc which is in form-locking driving connection with said drive shaft for said control roller, said control disc being provided with a control groove which is engaged by said control member.

3. A device for quickly stopping a remote controlled automatic cannon having a breech block which can be moved by means of an endless control groove in an essentially rotationally symmetrical control roller, wherein each region of the control groove is associated with a respective function step within the firing cycle of the cannon, said device comprising in combination:

an element which rotates in dependence on the rotation of said control roller, said element being provided with a stop abutment which is associated with a particular region of said control groove in said control roller;

a control piston having a first free end, said piston being mounted adjacent said element such that its said first free end can be axially moved into and out of the circular path of movement of said stop abutment;

means for applying an axial force on said piston to normally move said first free end into said path of movement and thus into a blocking position with respect to said stop abutment;

means for applying propellant gases developed during firing of the cannon to said piston to move said first free end out of said path of movement of said stop abutment and thus into a release position with respect to said stop abutment; and means for holding said control piston in said release position for a defined period during a firing cycle, with said means for holding including:

a blocking lever associated with said control piston; said blocking lever being articulated to a housing in which said control piston is mounted, said blocking lever having a free end which extends into the path of movement of said control piston between said first free end of said control piston and said path of movement of said stop abutment when said control piston is moved to said release position; and means for pivoting said blocking lever out of said path of movement of said control piston, so as to release said control piston for movement toward said element, in dependence on the movement of said control roller.

4. A device as claimed in claim 3 wherein said means for pivoting said blocking lever comprises a deflection cam disposed on the surface of said control roller so as to engage said blocking lever during rotation of said control roller.

5. A device as defined in claim 1 or 3 wherein said stop abutment is disposed on said control roller for the breech block.

6. A device as defined in claim 1 or 3 wherein said element has a supporting surface for said first free end of said control piston, and said stop abutment is disposed in a region of said supporting surface.

* * * * *